US011607880B2

(12) United States Patent
Sato et al.

(10) Patent No.: US 11,607,880 B2
(45) Date of Patent: Mar. 21, 2023

(54) RECORDING DEVICE AND RECORDING METHOD

(71) Applicant: SEIKO EPSON CORPORATION, Tokyo (JP)

(72) Inventors: Akito Sato, Nagano (JP); Masahiro Fukazawa, Nagano (JP); Takuma Hayashi, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 109 days.

(21) Appl. No.: 17/184,660

(22) Filed: Feb. 25, 2021

(65) Prior Publication Data

US 2021/0268795 A1 Sep. 2, 2021

(30) Foreign Application Priority Data

Feb. 27, 2020 (JP) ..... JP2020-031343

(51) Int. Cl.

*B41J 29/38* (2006.01)
*B41J 2/045* (2006.01)
*B41J 2/165* (2006.01)

(52) U.S. Cl.

CPC ..... *B41J 2/04541* (2013.01); *B41J 2/0454* (2013.01); *B41J 2/04566* (2013.01); *B41J 2/1652* (2013.01)

(58) Field of Classification Search

CPC ..... B41J 2/2054; B41J 2/2146; B41J 2/24
See application file for complete search history.

(56) References Cited

U.S. PATENT DOCUMENTS

2005/0185012 A1 8/2005 Yoshida
2009/0015849 A1* 1/2009 Jahana ..... B41J 2/2146 347/12
2010/0156980 A1* 6/2010 Azuma ..... B41J 3/543 347/14
2016/0031208 A1* 2/2016 Kobayashi ..... B41J 19/147 347/14
2019/0286955 A1* 9/2019 Hasegawa ..... H04N 1/034

FOREIGN PATENT DOCUMENTS

JP 2005-205691 A 8/2005

* cited by examiner

*Primary Examiner* — Lam S Nguyen
(74) *Attorney, Agent, or Firm* — Global IP Counselors, LLP

(57) ABSTRACT

A recording device includes a recording head and a control unit. When recording a raster line forming a partial image of a image, using, of a nozzle row, a plurality of OL nozzles in a positional relationship to record a common raster line, the control unit performs recording using the OL nozzles of a first range, in a range of the OL nozzles in a first direction, when a recording condition is a first recording condition, and performs recording using the OL nozzles of a second range narrower than the first range, of the range of the OL nozzles in the first direction, when the recording condition is a second recording condition in which a density difference, in the image, between the partial image and an image other than the partial image is greater than in the first recording condition.

7 Claims, 6 Drawing Sheets

RECORDING DEVICE AND RECORDING METHOD

The present application is based on, and claims priority from JP Application Serial Number 2020-031343, filed Feb. 27, 2020, the disclosure of which is hereby incorporated by reference herein in its entirety.

BACKGROUND

1. Technical Field

The present disclosure relates to a recording device and a recording method.

2. Related Art

A printer is known that performs recording on a recording medium, by alternately repeating scanning in a main scanning direction of a recording head that includes a nozzle row configured by a plurality of nozzles capable of ejecting ink, and transporting the recording medium in a transport direction that intersects the main scanning direction. Such a printer is able to execute a recording method that eliminates the occurrence of gaps between image regions recorded in each of scans, by causing the image region recorded by one of the scans and the image region recorded by the next scan to overlap.

A difference in density of a recording result may occur due to a number of scans used to perform the recording being different between the region recorded using the above-described overlap and a region that does not have the overlap, or the like. Such a density difference between the regions is visible as density unevenness.

Here, a technique is also known in which a correction value for correcting the density per raster line, which is a long line in the main scanning direction, is set, and dot formation per raster line is performed so as to achieve a density corrected on the basis of the correction value, thus suppressing the density unevenness (see JP-A-2005-205691).

However, the density of the regions recorded using the above-described overlap differs as a result of differences in recording conditions. Therefore, even if the correction is performed on the basis of the above-described set correction value, it may not necessarily be possible to make the density unevenness less noticeable.

SUMMARY

A recording device according to an aspect of the disclosure includes a recording head including a nozzle row including a plurality of nozzles configured to eject ink and arranged in a first direction, and a control unit configured to record an image on a recording medium by controlling the recording head, the image being formed by a plurality of raster lines that are long in a second direction intersecting the first direction. When recording a raster line forming a partial image of the image, using, of the nozzle row, a plurality of overlap nozzles in a positional relationship to record a common raster line, the control unit performs recording using the overlap nozzles of a first range, in a range of the overlap nozzles in the first direction, when a recording condition is a first recording condition, and performs recording using the overlap nozzles of a second range narrower than the first range, of the range of the overlap nozzles in the first direction, when the recording condition is a second recording condition in which a density difference between the partial image and an image other than the partial image, of the image, is greater than in the first recording condition.

A recording method according to an aspect of the present disclosure is a recording method for performing recording on a recording medium by controlling a recording head including a nozzle row including a plurality of nozzles configured to eject ink and arranged in a first direction. The recording method includes a recording step for recording, on the recording medium, an image formed by a plurality of raster lines that are long in a second direction intersecting the first direction. When recording a raster line forming a partial image of the image, using, of the nozzle row, a plurality of overlap nozzles in a positional relationship to record a common raster line, the recording step includes performing recording using the overlap nozzles of a first range, in a range of the overlap nozzles in the first direction, when a recording condition is a first recording condition, and performing recording using the overlap nozzles of a second range narrower than the first range, of the range of the overlap nozzles in the first direction, when the recording condition is a second recording condition in which a density difference between the partial image and an image other than the partial image, of the image, is greater than in the first recording condition.

DESCRIPTION OF EXEMPLARY EMBODIMENTS

Embodiments of the present disclosure will be described below with reference to the accompanying drawings. Note that each of the drawings is merely illustrative for describing a present embodiment. Since the drawings are illustrative, proportions and shapes may not be precise, may not match each other, or some components may be omitted.

1. SCHEMATIC DESCRIPTION OF SYSTEM

Figure 1:
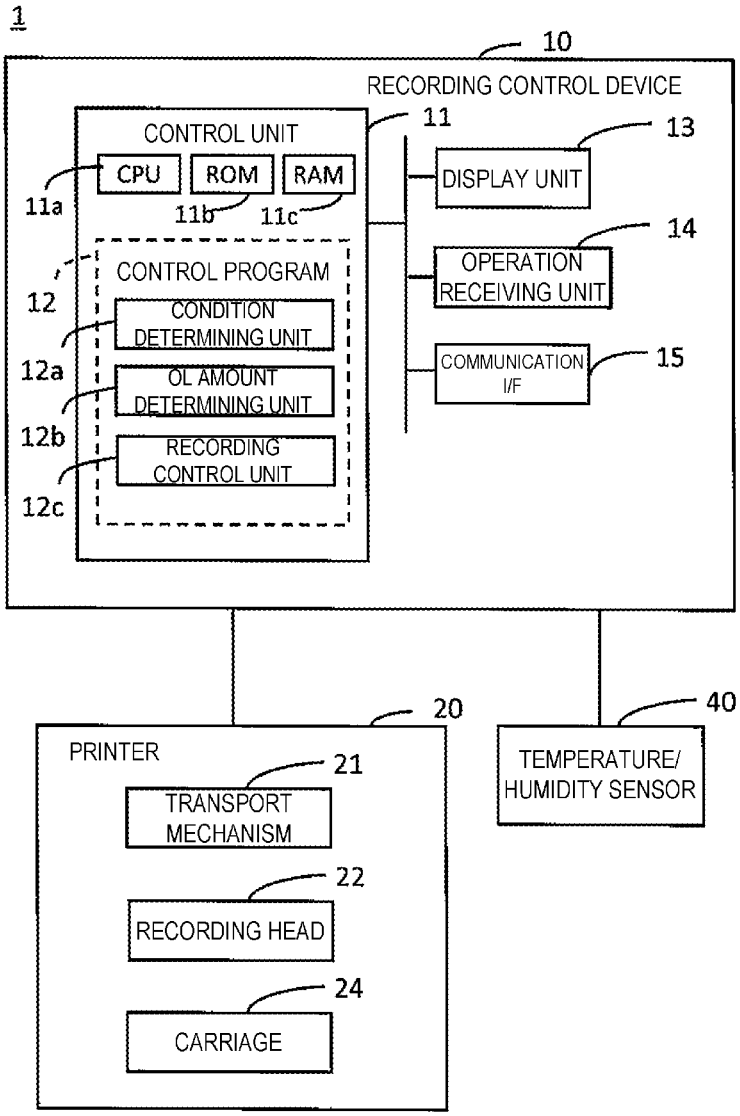
FIG. 1 is a block diagram schematically illustrating a configuration relating to a present embodiment.

FIG. 1 schematically illustrates a configuration of a system 1 according to the present embodiment. The system 1 includes a recording control device 10 and a printer 20. The system 1 may be referred to as a recording system, an image processing system, a printing system, or the like. At least part of the system 1 realizes a recording method.

The recording control device 10 is realized, for example, by a personal computer, a server, a smartphone, a tablet terminal, or an information processing device having the same degree of processing capability as these devices. The recording control device 10 is provided with a control unit 11, a display unit 13, an operation receiving unit 14, a communication interface 15, and the like. Interface is abbreviated as IF. The control unit 11 is configured to include one or more ICs including a CPU 11*a* as a processor, a ROM 11*b*, a RAM 11*c*, and the like, and another non-volatile memory, and the like.

In the control unit 11, the processor, that is, the CPU 11*a* executes arithmetic processing in accordance with a program stored in the ROM 11*b*, the other memory, or the like, using the RAM 11*c* or the like as a work area. By executing the processing in accordance with a recording control program 12, the control unit 11 works in concert with the recording control program 12 to realize a plurality of functions, such as a condition determining unit 12*a*, an OL amount determining unit 12*b*, a recording control unit 12*c*, and the like. "OL" is the abbreviation for overlap. Note that the processor is not limited to the single CPU, and may be configured by a plurality of the CPUs, may be configured to perform the processing using a hardware circuit such as an ASIC, or may have a configuration in which the CPU and the hardware circuit perform the processing in concert with each other.

The display unit 13 is a device for displaying visual information, and is configured, for example, by a liquid crystal display, an organic EL display, or the like. The display unit 13 may be configured to include a display and a drive circuit for driving the display. The operation receiving unit 14 is a device for receiving an operation by a user, and is realized, for example, by a physical button, a touch panel, a mouse, a keyboard, or the like. Of course, the touch panel may be realized as a function of the display unit 13. The display unit 13 and the operation receiving unit 14 can be referred to as an operating panel of the recording control device 10.

The display unit 13 and the operation receiving unit 14 may be a part of the configuration of the recording control device 10, or may be peripheral devices externally coupled to the recording control device 10. The communication IF 15 is a collective term for one or more IFs used by the recording control device 10 to perform wired or wireless communication with the outside in accordance with a prescribed communication protocol including a known communication standard. The control unit 11 communicates with the printer 20 via the communication IF 15.

The printer 20, which is a recording device controlled by the recording control device 10, is an inkjet printer that ejects dots of ink and performs recording. The dots are also referred to as droplets. Although a detailed description of the inkjet printer is omitted, the printer 20 is generally provided with a transport mechanism 21, a recording head 22, and a carriage 24. The transport mechanism 21 includes a roller that transports the recording medium, a motor for driving the roller, and the like, and transports the recording medium in a predetermined transport direction.

Figure 2:
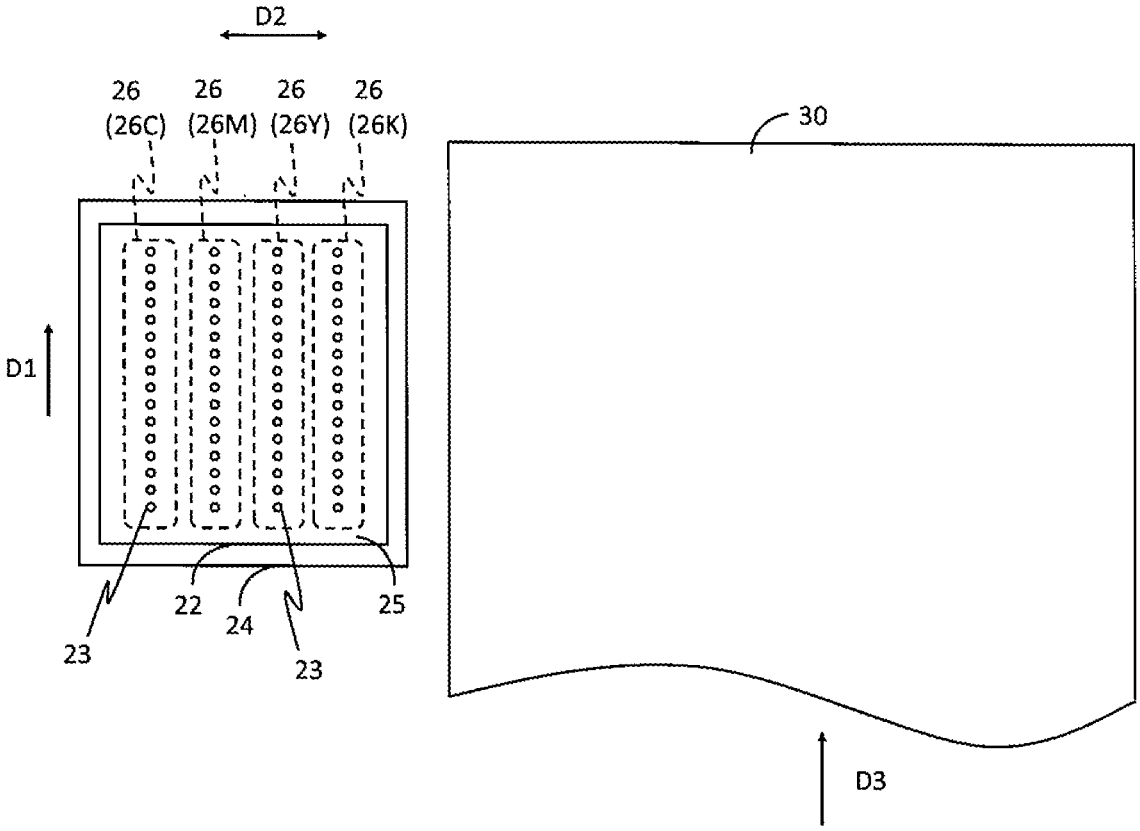
FIG. 2 is a diagram illustrating, from above, an example of a relationship between a recording medium and a recording head.

As illustrated in FIG. 2, the recording head 22 is provided with a plurality of nozzles 23 capable of ejecting the dots, and ejects the dots from each of the nozzles 23 onto the recording medium 30 transported by the transport mechanism 21. By controlling application of a drive signal to a driving element (not illustrated) provided in the nozzle 23, in accordance with dot data described below, the printer 20 ejects or does not eject the dot from the nozzle 23. For example, to perform the recording, the printer 20 ejects ink of each color of cyan (C), magenta (M), yellow (Y), and black (K), inks of colors other than these colors, or a liquid. In the present embodiment, the printer 20 is described as being a type for ejecting CMYK inks.

FIG. 2 schematically illustrates a relationship between the recording head 22 and the recording medium 30. The recording head 22 may be referred to as a printing head, a print head, a liquid ejection head, or the like. The recording medium 30 is typically paper, but may be a material other than paper as long as it is a material on which the recording is possible as a result of the ejection of liquid. The recording head 22 is mounted on the carriage 24 that can reciprocate along a direction D2, and moves together with the carriage 24. The direction D2 is also referred to as the main scanning direction. The transport mechanism 21 transports the recording medium 30 in a direction D3 that intersects the main scanning direction D2. The direction D3 is the transport direction. The intersection of the direction D2 and the direction D3 may be essentially orthogonal, but need not necessarily be strictly orthogonal, due to various tolerances in the printer 20 as a product, for example.

The reference sign 25 denotes a nozzle surface 25 in which the nozzles 23 in the recording head 22 open. FIG. 2 illustrates an example of an arrangement of the nozzles 23 in the nozzle surface 25. Individual small circles in the nozzle surface 25 are the nozzles 23. The recording head 22 is provided with a nozzle row 26 for each ink color, in a configuration in which each of the CMYK inks is supplied from an ink holding unit (not illustrated), which is referred to as an ink cartridge, an ink tank, or the like and is mounted in the printer 20. The nozzle row 26 formed by the nozzles 23 that eject the C ink is also described as a nozzle row 26C. Similarly, the nozzle row 26 formed by the nozzles 23 that eject the M ink is also described as a nozzle row 26M, the nozzle row 26 formed by the nozzles 23 that eject the Y ink is also described as a nozzle row 26Y, and the nozzle row 26 formed by the nozzles 23 that eject the K ink is also described as a nozzle row 26K. The nozzle rows 26C, 26M, 26Y, and 26K are arranged side by side along the main scanning direction D2.

The nozzle row 26 corresponding to one of the ink colors is configured by the plurality of nozzles 23 at a constant nozzle pitch, which is an interval between the nozzles 23 in the transport direction D3. The direction D1 in which the plurality of nozzles 23 configuring the nozzle row 26 are arranged is referred to as a nozzle row direction. The nozzle row direction D1 corresponds to a "first direction", and the main scanning direction D2 corresponds to a "second direction". In the example illustrated in FIG. 2, the nozzle row direction D1 is parallel with the transport direction D3. In a configuration in which the nozzle row direction D1 is parallel with the transport direction D3, the nozzle row direction D1 and the main scanning direction D2 are orthogonal to each other. In this case, the nozzle row direction D1 and the transport direction D3 may be understood to be the same. However, the nozzle row direction D1 need not necessarily be parallel with the transport direction D3, and a configuration may be adopted in which the nozzle row direction D1 obliquely intersects the main scanning direction D2. The positions of each of the nozzle rows 26C, 26M, 26Y, and 26K in the transport direction D3 are aligned with each other.

According to the example illustrated in FIG. 2, the printer 20 is a so-called serial type printer, and performs the recording on the recording medium 30 by alternately repeating transport of the recording medium 30 in the transport direction D3 by a predetermined transport amount, and ink ejection by the recording head 22 in accordance with the movement of the carriage 24 along the main scanning direction D2. The ink ejection by the recording head 22 in accordance with a forward movement or a return movement of the carriage 24 along the main scanning direction D2 is also referred to as a scan or a pass.

The recording control device 10 is further communicatively coupled to a temperature/humidity sensor 40. The temperature/humidity sensor 40 measures the temperature and humidity of the environment in which the printer 20 is placed, and outputs measurement results to the recording control device 10. The temperature/humidity sensor 40 may be a part of the recording control device 10 or the printer 20. However, the temperature/humidity sensor 40 is not an essential configuration in the system 1. The recording control device 10 may be able to acquire temperature and humidity information by any method, including an input by a user.

The recording control device 10 and the printer 20 may be coupled via a network (not illustrated). In addition to the printing function, the printer 20 may be a composite machine that combines a plurality of functions, such a scanner function, a facsimile communication function, or the like. The recording control device 10 may be realized by a single independent information processing device, or may also be realized by a plurality of information processing devices communicatively coupled to each other via a network.

Alternatively, the recording control device 10 and the printer 20 may be a recording device in which they are integrated. In other words, the recording control device 10 is a part of the configuration included in the printer 20 that is the recording device, and processing executed by the recording control device 10 described below may be interpreted as processing executed by the printer 20.

2. RECORDING CONTROL PROCESSING

Figure 3:
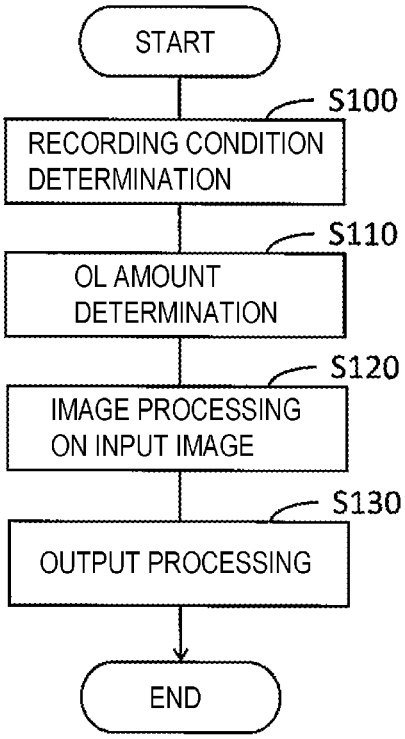
FIG. 3 is a flowchart illustrating recording control processing.

FIG. 3 illustrates, using a flowchart, recording control processing implemented by the control unit 11 in accordance with the recording control program 12. As a result of the recording control processing, the control unit 11 performs control such that, on the recording medium 30, the printer 20 records an image that is formed by the long "raster line" in the second direction intersecting the first direction. A recording method according to the present embodiment is realized by the recording control processing. Taking the configuration illustrated in FIG. 2 as an example, the raster line is a long line in the main scanning direction D2, which is represented by pixels arranged in the main scanning direction D2.

When the control unit 11 receives an input image recording command, the control unit 11 starts the recording control processing. The user freely selects the input image, by operating the operation receiving unit 14 while viewing a UI screen displayed on the display unit 13, for example, and executes the input image recording command. UI is an abbreviation for user interface. Further, via the UI screen, the user can freely select at least some of recording conditions for the input image, or can change default recording conditions. The recording conditions are combinations of various conditions and environments relating to the recording. The recording conditions include, for example, a recording speed by the printer 20 and a type of the recording medium 30. In addition to these, the recording conditions can be changed by selecting color recording or monochrome recording, or selecting one side recording or recording on both sides.

At step S100, the condition determining unit 12*a* determines whether the recording condition corresponds to both a "first recording condition" and a "second recording condition". In the present embodiment, when a certain recording condition is referred to as the first recording condition, the recording condition in which a density of an "OL recorded image" is denser than that of the first recording condition is referred to as the second recording condition. The OL recorded image is a partial image of the input image.

The OL recorded image is an image region formed by an OL raster line, which is the raster line recorded by OL recording. The "OL recording" is a method in which, when focusing on the recording of the single raster line using the single color ink, the recording is performed by allocating the raster line to the plurality of nozzles 23 ejecting the ink of the single color. When the printer 20 is the serial printer, recording the single raster line using a plurality of passes corresponds to the OL recording. For convenience, the raster line that is not the OL raster line is referred to as a normal raster line, and an image region formed by the normal raster line in the input image is called a "normal recorded image". When the printer 20 is the serial printer, the normal raster line is recorded in a single pass.

Note that when the recording condition changes from the first recording condition to the second recording condition, it goes without saying that the density of the normal recorded image may not necessarily become denser. The density of the normal recorded image in the recording result may also change depending on the difference in the recording condition. However, since the recording methods are different, the normal recorded image and the OL recorded image do not change in the same manner depending on the difference in the recording condition. Thus, the second recording condition can be said to be a recording condition in which, in comparison to the first recording condition, the difference in the density increases between the OL recorded image and the normal recorded image, which, of the input image, is the image other than the OL recorded image.

Several specific examples of the first recording condition and the second recording condition will be described below.

First Example

The recording speed of the second recording condition is slower than that of the first recording condition. The user may select, via the UI screen, the recording speed used by the printer 20. For example, a plurality of recording modes having different recording speeds, such as "Best", "Normal", and "Fast", are presented on the UI screen. The user freely selects the mode from among these recording modes and consequently selects the recording speed. "Best" is, for example, a mode in which the recording is performed with the movement speed of the carriage 24 at its slowest, in order to increase the resolution of the recording resolution in the main scanning direction D2. "Normal" is a mode in which the movement speed of the carriage 24 is faster than in the "Best" mode, and "Fast" is a mode in which the movement speed of the carriage 24 is faster than in the "Normal" mode.

The slower the movement speed of the carriage 24, the longer the time between a previous pass and a subsequent pass for recording the OL raster line, and a drying time of the dots landed on the recording medium 30 in the previous pass is secured for a longer period of time. The OL raster line in which the dots are partially superimposed in the subsequent pass with respect to the dots for which the longer drying time after landing is secured tend to develop to be denser on the recording medium 30, compared to the OL raster line in which the dots are partially superimposed in the subsequent pass with respect to the dots that have the shorter drying time after landing. Therefore, when the recording speed is slow, it can be said that the density of the OL recorded image becomes denser. Then, since the density of the OL recorded image becomes denser in this way, it can be said that the density difference increases between the OL recorded image and the normal recorded image configured by the normal raster line.

Based on such a perspective, at step S100, when "Normal" or "Fast" is selected as the recording mode, for example, the condition determining unit 12*a* determines that the recording condition is the first recording condition. On the other hand, when "Best" is selected as the recording mode, the condition determining unit 12*a* determines that the recording condition is the second recording condition.

Second Example

The second recording condition is a lower temperature than the first recording condition. When the temperature of the environment in which the printer 20 is placed is low, bleed-through of the ink in the recording medium 30 easily occurs. The dots spread out as a result of the bleed-through, and cover a wider area. When the temperature is low, the dots that have landed on the recording medium 30 in the previous pass for recording the OL raster line spread and cover a wider area during the interval before the dots of the subsequent pass land. As a result, the OL raster line is likely to become denser than the normal raster line. In other words, it can be said that when the temperature is low, the density of the OL recorded image becomes denser. Then, when the density of the OL recorded image becomes denser in this way, the density difference between the OL recorded image and the normal recorded image increases.

Based on such a perspective, at step S100, the condition determining unit 12*a* may determine that the recording condition is the first recording condition when the temperature obtained from the temperature/humidity sensor 40 or the like is equal to or greater than a predetermined threshold for the temperature, and may determine that the recording condition is the second recording condition when the temperature is less than the threshold value for the temperature.

Third Example

The second recording condition is a higher humidity than the first recording condition. When the humidity of the environment in which the printer 20 is placed is high, the bleed-through of the ink in the recording medium 30 easily occurs. When the humidity is high, the dots that have landed on the recording medium 30 in the previous pass for recording the OL raster line spread and cover a wider area during the interval before the dots of the subsequent pass land. As a result, the OL raster line is likely to become denser than the normal raster line. In other words, it can be said that when the humidity is high, the density of the OL recorded image becomes denser, and the density difference between the OL recorded image and the normal recorded image increases.

Based on such a perspective, at step S100, the condition determining unit 12*a* may determine that the recording condition is the first recording condition when the humidity obtained from the temperature/humidity sensor 40 or the like is equal to or less than a predetermined threshold value for the humidity, and may determine that the recording condition is the second recording condition when the humidity exceeds the threshold value for humidity.

Fourth Example

The second recording condition uses the recording medium 30 for which the bleed-through of the ink is more likely to occur than in the recording medium 30 used in the first recording condition. The user may select, via the UI screen, the type of the recording medium 30 used by printer 20. Here, the type of the recording medium 30 is broadly divided into a first recording medium, and a second recording medium in which the ink bleed-through is more likely to occur than the first recording medium. The second recording medium is, for example, plain paper, or a medium of a type for which the likelihood of the ink bleed-through is substantially the same as for the plain paper, or is greater than for the plain paper. The first recording medium is, for example, glossy paper or the like.

As can be understood from the above description, in an environment in which the bleed-through of the ink is likely to occur, in comparison to an environment in which the bleed-through of the ink is less likely to occur, the density tends to become denser when the OL recorded image is recorded, and thus, the density difference between the OL recorded image and the normal recorded image increases. Thus, at step S100, when the type of the recording medium 30 selected for use in the printer 20 is the first recording medium, the condition determining unit 12*a* may determine that the recording condition is the first recording condition, and, when the recording medium 30 selected is the second recording medium, the condition determining unit 12*a* may determine that the recording condition is the second recording condition.

Note that the first recording condition can be considered to be a predetermined recording condition in which, in the recording result, the density difference between the OL recorded image and the normal recorded image is relatively small, and the OL recorded image is not conspicuous.

At step S100, any of the first to fourth examples described above may be employed.

Next, at step S110, the OL amount determining unit 12*b* determines an OL amount in the nozzle rows 26, in accordance with the result of the determination of the recording condition at step S100. The OL amount indicates a range of the nozzles 23 used in the actual OL recording, within a range of OL nozzles that are in a positional relationship at which, of the nozzles 23 of the nozzle rows 26, the recording of the common raster line is possible. The range of the OL nozzles is a range fixed within the nozzle row 26, and is referred to below as an "OL nozzle range". The OL amount may be understood to be a size of the OL recorded image in the input image. When the OL amount is reduced, a ratio of the normal recorded image increases and a ratio of the OL recorded image decreases. The OL amount determining unit 12*b* determines the OL amount to be a "first range" when the recording condition is the first recording condition, and determines the OL amount to be a "second range" that is narrower than the first range when the recording condition is the second recording condition.

At step S120, the recording control unit 12*c* executes necessary image processing on the input image to generate dot data for the printer 20 to perform the recording of the input image.

First, the recording control unit 12*c* acquires, from a predetermined input source, image data representing the input image that has been freely selected by the user. The image data acquired here is bitmap data including a plurality of pixels, and includes gray scale values of red (R), green (G), and blue (B) for each pixel, for example. The gray scale values are represented by 256 gradations from 0 to 255, for example. When the acquired image data does not correspond to such an RGB color system, the recording control unit 12*c* may convert the acquired image data to the data of that color system. Furthermore, the recording control unit 12*c* performs resolution conversion processing, on the image data, for matching the image data with the recording resolution corresponding to the recording condition and the recording mode.

Furthermore, the recording control unit 12*c* performs color conversion processing on the image data. In other words, the recording control unit 12*c* converts the color system of the image data to the color system of the ink used by the printer 20 for the recording. As described above, when the image data represents the color of each of the pixels using RGB values, the recording control unit 12*c* converts, for each of the pixels, the RGB gray scale values to gray scale values for each of CMYK. The color conversion processing can be performed by referring to any color conversion lookup table defining a conversion relationship from RGB to CMYK.

The recording control unit 12*c* generates the dot data by performing halftone processing on the image data after the color conversion, that is, the image data in which each of the pixels includes the gray scale values indicating an ink amount for each of CMYK. The halftone processing is performed using a dither method or an error diffusion method, for example. The dot data is data defining dot ejection (dot on) or non-ejection (dot off) for each of the pixels and for each of CMYK. Such image processing at step S120 may be performed at least partially in parallel with the processing at step S100 and step S110.

At step S130, the recording control unit 12*c* performs output processing for causing the printer 20 to perform the recording based on the dot data generated at step S120. Specifically, the dot data is sorted into an order to be transferred to the printer 20, in accordance with a predetermined transport amount and the OL amount determined at step S110. The sorting processing is also referred to as rasterization processing. In the rasterization processing, of the raster lines configuring the dot data, the recording control unit 12*c* allocates each of the pixels configuring the raster lines that are the OL raster lines corresponding to the OL amount to a plurality of passes. Of the plurality of passes for recording a given one of the OL raster lines, a pass of a previous time is referred to as a previous pass, and a pass of a subsequent time is referred to as a subsequent pass.

As a result of the rasterization processing, it is determined in which pass, at which timing and by which of the nozzles 23 the dots of ink defined by the dot data will be ejected, in accordance with a pixel position and an ink color thereof. The recording control unit 12*c* transmits the dot data after the rasterization processing to the printer 20, along with recording condition information and the like. As a result of the printer 20 driving the transport mechanism 21, the recording head 22, and the carriage 24 on the basis of the information including the dot data transmitted from the recording control device 10, the printer 20 records the input image represented by the dot data on the recording medium 30. When the type of the recording medium 30 is selected by the user, of course, the printer 20 performs the recording on the selected type of the recording medium 30.

Figure 4:
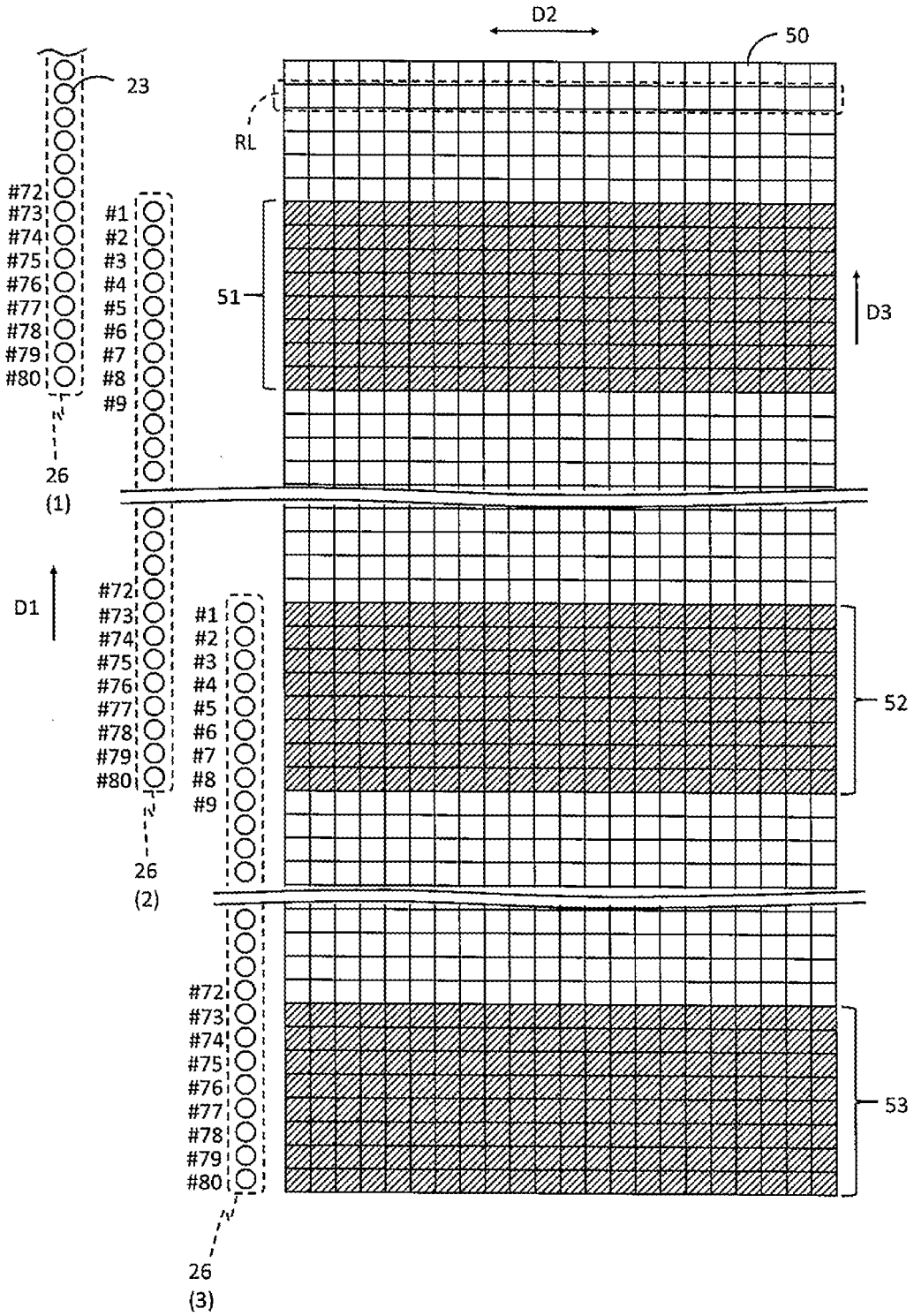
FIG. 4 is a diagram illustrating a relationship between nozzles and pixel allocation when an OL amount is in a first range.

FIG. 4 illustrates a correspondence relationship between the nozzles 23 and a pixel allocation when the OL amount is determined to be the first range. A reference sign 50 denotes a part of the image data representing the input image. Each of rectangles configuring the image data 50 is one of the pixels configuring the image data 50. The image data 50 may be understood to be dot data 50 after undergoing the image processing at step S120. Further, the dot data 50 may be understood to be the dot data in which, of the dot data for each of CMYK, the dot on and dot off of one of the ink colors is defined for each of the pixels. In FIG. 4, correspondence relationships between the dot data 50 and the directions D1, D2, and D3 are also illustrated. A reference sign RL denotes a single pixel row, that is, the single raster line, in which a plurality of the pixels are arranged along the main scanning direction D2.

FIG. 4 illustrates the nozzle row 26 formed by the plurality of nozzles 23 that eject the single color ink to which the dot data 50 corresponds. In FIG. 4, the nozzle row 26 is configured by 80 of the nozzles 23 arranged in the nozzle row direction D1. For ease of understanding, in FIG. 4, nozzle numbers #1 to #80 in order from downstream to upstream in the transport direction D3 are assigned to each of the nozzles 23 configuring the nozzle row 26. Below, upstream and downstream in the transport direction D3 are referred to simply as upstream and downstream. Of course, a configuration in which the number of nozzles in the nozzle row 26 is 80 is one example, and the number of nozzles in the nozzle row 26 is not limited. As described above, the recording head 22 includes the plurality of nozzle rows 26 respectively corresponding to each of a plurality of the ink colors, such as CMYK. The correspondence relationship between the nozzle row 26 and the dot data 50 relating to the one ink color described in FIG. 4 is common to each of the ink colors.

All of the nozzle rows 26 illustrated in FIG. 4 are the same nozzle row 26. In other words, in FIG. 4, it is illustrated that a relative positional relationship between the nozzle row 26 and the dot data 50 in the transport direction D3 changes for each pass of the recording head 22. In FIG. 4, numbers 1, 2, 3 . . . , denoted in parentheses along with the reference sign 26, represent which number pass the nozzle row 26 corresponds to at that time. In FIG. 4, the nozzle row 26 appears to be moving upstream each time the pass number increases. In actuality, by the transport mechanism 21 transporting the recording medium 30 downstream by the predetermined transport amount between each of the passes, the positional relationship between the nozzle row 26 and the dot data 50 in each of the passes, as illustrated in FIG. 4, is reproduced as the recording result on the recording medium 30. In FIG. 4, the nozzle row 26 for each of the passes is illustrated as being shifted in the main scanning direction D2, but this is for ease of illustration and does not mean that there is a difference in position in the main scanning direction D2 of the nozzle row 26 for each of the passes.

In the example illustrated in FIG. 4, the predetermined transport amount by the transport mechanism 21 between the passes is a distance 72 times the distance of the nozzle pitch. In this way, each of the raster lines RL recorded in a given pass by each of the nozzles 23 having the upstream nozzle numbers #73 to #80 of the nozzle row 26 can be recorded by each of the nozzles 23 having the downstream nozzle numbers #1 to #8 of the nozzle row 26 in the next pass. Specifically, each of the nozzles 23 having the nozzle numbers #1 to #8 and each of the nozzles 23 having the nozzle numbers #73 to #80 correspond to the "OL nozzle" that is in a positional relationship capable of recording the common raster line RL, and the nozzle range of the nozzle numbers #1 to #8 and the nozzle range of the nozzle numbers #73 to #80 are the OL nozzle ranges. As illustrated in FIG. 4, for example, the raster line RL recorded by the nozzle 23 having the nozzle number #73 in a given pass can be recorded by the nozzle 23 having the nozzle number #1 in the next pass.

The first range may be a partial range of the OL nozzle range, but here, by way of example, the first range is assumed to be all of the OL nozzle range. When the OL amount is determined to be the first range at step S110, at step S130, the recording control unit 12*c* allocates each of the pixels configuring each of the raster lines RL corresponding to the first range of the dot data 50 to the nozzles 23 of the first range in the previous pass and to the nozzles of the first range in the subsequent pass.

In FIG. 4, hatched regions 51, 52, and 53 of the dot data 50 are the OL recorded images that are to be recorded by the OL recording by the nozzles 23 of the first range, and regions other than the OL recorded images 51, 52, and 53 are the normal recorded images. Each of the raster lines RL configuring the OL recorded images 51, 52, and 53 is the OL raster line. The hatching in the dot data 50 is a convenient way of identifying the OL recorded image, and does not relate in any way to the dot on and dot off for each of the pixels represented by the dot data 50.

Of the nozzle range of the nozzle numbers #1 to #8 and the nozzle range of the nozzle numbers #73 to #80, which are the first range, the nozzle range of the nozzle numbers #1 to #8 is referred to as a first downstream range, and the nozzle range of the nozzle numbers #73 to #80 is referred to as a first upstream range. According to FIG. 4, for each of the raster lines RL configuring the OL recorded image 51, the recording control unit 12*c* allocates the pixels to each of the nozzles 23 in the first upstream range of the nozzle row 26 in the first pass and each of the nozzles 23 in the first downstream range of the nozzle row 26 in the second pass. For example, for the raster line RL located furthest downstream in the OL recorded image 51, some of the pixels configuring this raster line RL are allocated to the nozzle 23 having the nozzle number #73 in the first pass, and the remaining pixels configuring this raster line RL are allocated to the nozzle 23 having the nozzle number #1 in the second pass.

There are various methods for allocating each of the pixels configuring the raster line RL to the previous pass and the subsequent pass, respectively. For example, the recording control unit 12*c* may alternately allocate each of the pixels arranged in the main scanning direction D2 in the one raster line RL to the OL nozzle of the previous pass and to the OL nozzle of the subsequent pass used for the OL recording of this raster line RL. Similarly, according to FIG. 4, for each of the raster lines RL configuring the OL recorded image 52, the recording control unit 12*c* allocates the pixels to each of the nozzles 23 in the first upstream range of the nozzle row 26 in a second pass, and to each of the nozzles 23 in the first downstream range of the nozzle row 26 in a third pass. Similarly, for each of the raster lines RL configuring the OL recorded image 53, the recording control unit 12*c* allocates the pixels to each of the nozzles 23 in the first upstream range of the nozzle row 26 in the third pass, and to each of the nozzles 23 in the first downstream range of the nozzle row 26 in a fourth pass. In FIG. 4, the nozzle row 26 of the fourth and subsequent passes is not illustrated, due to limitations on paper.

For each of the raster lines RL configuring the normal recorded image of the dot data 50, in order to record the single raster line RL in a single pass, the recording control unit 12*c* allocates all of the pixels in the raster line RL to the corresponding one of the nozzles 23. According to FIG. 4, for example, for the raster line RL adjacent to and in a position downstream of the OL recorded image 51, the recording control unit 12*c* allocates all of the pixels configuring this raster line RL to the nozzle 23 having the nozzle number #72 in the first pass. Further, for example, for the raster line RL adjacent to and in a position downstream of the OL recorded image 52, the recording control unit 12*c* allocates all of the pixels configuring this raster line RL to the nozzle 23 having the nozzle number #72 in the second pass. When the recording condition is the first recording condition, as a result of step S130 that includes such allocation processing, the OL recording is performed for each of the raster lines RL of the OL recorded images 51, 52, and 53, as illustrated in FIG. 4, and the recording of each of the raster lines RL of the respective normal recorded images is performed in the single pass.

Figure 5:
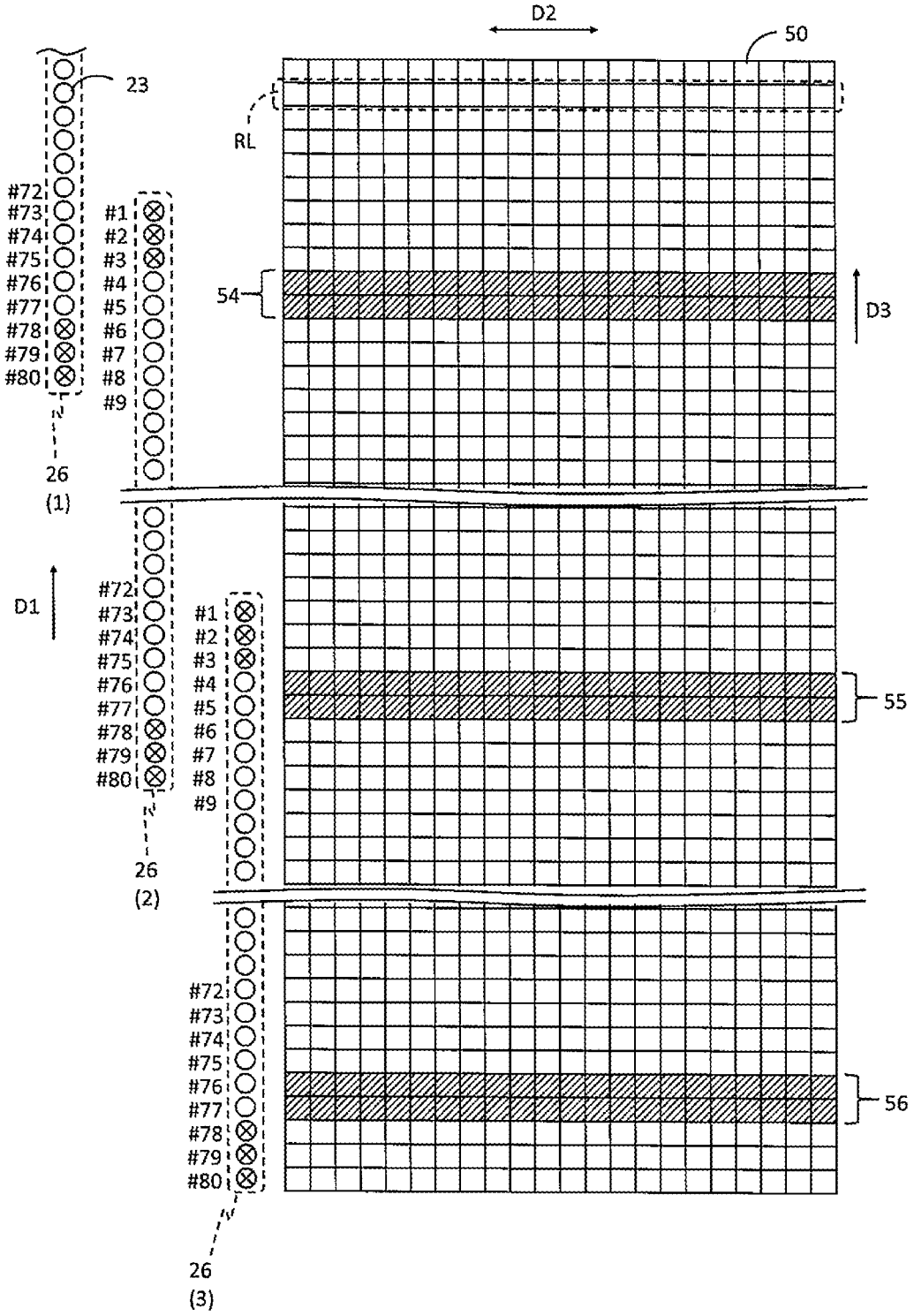
FIG. 5 is a diagram illustrating the relationship between the nozzles and the pixel allocation when the OL amount is in a second range.

FIG. 5 illustrates a correspondence relationship between the nozzles 23 and the pixel allocation when the OL amount is determined to be the second range. The way of viewing FIG. 5 is the same as that of FIG. 4. In relation to FIG. 5, a description that is different from that relating to FIG. 4 will be described. The second range is narrower than the first range. Here, as an example, of the nozzle range of the nozzle numbers #1 to #8 and the nozzle range of the nozzle numbers #73 to #80, which are the OL nozzle ranges, the nozzle range of the nozzle numbers #4 and #5 and the nozzle range of the nozzle numbers #76 and #77 are the second range.

When, at step S110, the OL amount is determined to be the second range, at step S130, the recording control unit 12*c* allocates each of the pixels configuring each of the raster lines RL corresponding to the second range of the dot data 50 to the nozzles 23 of the second range in the previous pass and the nozzles 23 of the second range in the subsequent pass. In FIG. 5, hatched regions 54, 55, and 56 of the dot data 50 are the OL recorded images that are to be recorded by the OL recording by the nozzles 23 of the second range, and regions other than the OL recorded image 54, 55, and 56 are the normal recorded images. Each of the raster lines RL configuring the OL recorded images 54, 55, and 56 is the OL raster line.

Of the nozzle range of the nozzle numbers #4 and #5 and the nozzle range of the nozzle numbers #76 and #77, which are the second range, the nozzle range of the nozzle numbers #4 and #5 is referred to as a second downstream range, and the nozzle range of the nozzle numbers #76 and #77 is referred to as a second upstream range. According to FIG. 5, for each of the raster lines RL configuring the OL recorded image 54, the recording control unit 12*c* allocates the pixels to each of the nozzles 23 in the second upstream range of the nozzle row 26 in the first pass and each of the nozzles 23 in the second downstream range of the nozzle row 26 in the second pass. For example, for the raster line RL located furthest downstream in the OL recorded image 54, some of the pixels configuring this raster line RL are allocated to the nozzle 23 having the nozzle number #76 in the first pass, and the remaining pixels configuring this raster line RL are allocated to the nozzle 23 having the nozzle number #4 in the second pass.

Similarly, according to FIG. 5, for each of the raster lines RL configuring the OL recorded image 55, the recording control unit 12*c* allocates the pixels to each of the nozzles 23 in the second upstream range of the nozzle row 26 in the second pass and each of the nozzles 23 in the second downstream range of the nozzle row 26 in the third pass. Similarly, for each of the raster lines RL configuring the OL recorded image 56, the recording control unit 12*c* allocates the pixels to each of the nozzles 23 in the second upstream range of the nozzle row 26 in the third pass and each of the nozzles 23 in the second downstream range of the nozzle row 26 in the fourth pass.

When the OL amount is the second range, of the OL nozzle range, the recording control unit 12*c* sets, as unused nozzles, the nozzles 23 further to an end side of the nozzle row 26 than the second range used for the OL recording. The unused nozzle is the nozzle 23 to which pixel information is not allocated at step S130. The unused nozzle does not eject the ink. In FIG. 5, of the OL nozzle range, the nozzles 23 having the nozzle numbers #1 to #3 and #78 to #80 that are further to the end sides than the second range in the nozzle row 26 are the unused nozzles. In FIG. 5, the unused nozzle is denoted by an "x" mark.

Also when the OL amount is the second range, for each of the raster lines RL configuring the normal recorded image, of the dot data 50, the recording control unit 12*c* allocates all of the pixels in the raster line RL to the single nozzle 23. When the OL amount is the second range, of the OL nozzle range, each of the nozzles 23 having the nozzle numbers #6 to #8 and #73 to #75, which do not belong to the second range and are not the unused nozzles, is used to record the raster line RL of the normal recorded image, in the same manner as each of the nozzles 23 having the nozzle numbers #9 to #72 that are not in the OL nozzle range. According to FIG. 5, for example, for the raster line RL adjacent to and in a position downstream of the OL recorded image 54, the recording control unit 12*c* allocates all of the pixels configuring this raster line RL to the nozzle 23 having the nozzle number #75 in the first pass. Further, for example, for the raster line RL adjacent to and in a position upstream of the OL recorded image 54, the recording control unit 12*c* allocates all of the pixels configuring this raster line RL to the nozzle 23 having the nozzle number #6 in the second pass.

When the recording condition is the second recording condition, as a result of step S130 that includes such allocation processing, of the input image, the OL recording is performed for each of the raster lines RL of the OL recorded images 54, 55, and 56, as illustrated in FIG. 5, and the recording of each of the raster lines RL of the respective normal recorded images is performed in the single pass. As is clear when comparing FIG. 5 with FIG. 4, since the OL amount is the second range as a result of the recording condition being the second recording condition, of the image recorded on the recording medium 30, the ratio of the OL recorded image decreases.

As described above, in the OL nozzle range, the second range is narrower than the first range. Specifically, the second upstream range is a part of the first upstream range, and the second downstream range is a part of the first downstream range. Further, according to the examples illustrated in FIG. 4 and FIG. 5, the second range is a central range that does not include both of end portions of the OL nozzle range in the nozzle row direction D1. Specifically, the second upstream range (nozzle numbers #76 to #77) is the central range not including both the end portions of the upstream OL nozzle range (nozzle numbers #73 to #80), and similarly, the second downstream range (nozzle numbers #4 and #5) is the central range not including both the end portions of the downstream OL nozzle range (nozzle numbers #1 to #8).

The recording control unit 12*c* may perform density correction for each of the raster lines in the image processing on the input image at step S120. Although a detailed description of the density correction for each of the raster lines is omitted, the control unit 11 performs processing in advance to acquire a colorimetric value of a predetermined test pattern recorded on the recording medium 30 by the printer 20, and acquire a correction value for the density of each of the raster lines, based on a comparison between the colorimetric value and a colorimetric reference value serving as a reference for the correction. Then, at step S120, for example, with respect to the input data representing the input image using the CMYK gray scale values, the recording control unit 12*c* uses the correction value to correct the CMYK gray scale values for each of the raster lines. In this way, in the recording results of the input image based on the dot data after the halftone processing, density unevenness for each of the raster lines can be suppressed to a certain extent.

3. CONCLUSION

As described above, according to the present embodiment, the recording device is provided with the recording head 22 including the nozzle row 26 in which the plurality of nozzles 23 capable of ejecting the ink are arranged in the first direction, and the control unit 11 that, by controlling the recording head 22, causes the image formed by the plurality of raster lines that are long in the second direction intersecting the first direction to be recorded on the recording medium 30. Then, when the control unit 11.

By correcting variations in the density per raster line using the density correction per raster line performed in known art, as a result, density unevenness between the OL recorded image and the normal recorded image can also be suppressed to a certain extent. However, the density difference between the OL recorded image and the normal recorded image is changed by the differences in the recording condition. Thus, simply by performing the density correction using a correction value per raster line that is available in advance, it is difficult to appropriately suppress the density unevenness between the OL recorded image and the normal recorded image, the extent of which changes due to the influence of the recording condition. With respect to such a situation, in the present embodiment, when the recording condition is the second recording condition, the range of nozzles used for the OL recording is reduced compared to when the recording condition is the first recording condition, and, of the image to be recorded on the recording medium 30, an amount of the partial image (the OL recorded image) for which the OL recording is to be performed is reduced. In this way, the visibility of the OL recorded image throughout the image as a whole can be lowered, and the density unevenness between the OL recorded image and the normal recorded image can be made inconspicuous.

The OL recorded image is the region that is intentionally formed to prevent a gap caused by a transport error of the recording medium 30 from occurring between each of image regions recorded as a set in each pass. Thus, generally, when the amount of the OL recorded image is reduced, an effect of filling the gap deteriorates. However, in the present embodiment, the amount of the OL recorded image is reduced in the case of the second recording condition in which the density of the OL recorded image is high. The second recording condition in which the density of the OL recorded image increases is a recording condition in which the area covered by the dots resulting from the OL recording tends to be larger, so if a configuration is adopted in which the amount of the OL recorded image is reduced in the case of such a recording condition, it is possible to avoid a deterioration in the effect of filling the gaps.

Further, according to the present embodiment, a case in which the recording speed is slower than the first recording condition, a case in which the temperature is lower than the first recording condition, a case in which the humidity is higher than the first recording condition, or a case in which a recording medium is used in which the bleed-through of the ink is more likely than the recording medium used in the first recording condition, is defined as the second recording condition. In this way, by appropriately determining the first recording condition or the second recording condition, the range of nozzles used for the OL recording can be determined.

Further, according to the present embodiment, the second range may be the central range not including both the end portions of the OL nozzle range in the first direction.

Both the end portions of the OL nozzle range may correspond to the end portions of the nozzle row 26. A tendency is observed for the nozzles 23 at the end portions of the nozzle row 26 to be relatively lacking in dot ejection accuracy, such as the trajectory of the dot being more likely to curve and so on. By setting the second range to the central range not including both the end portions of the OL nozzle range in the first direction, it is possible to secure the image quality of the OL recorded image in the second recording condition in which the number of raster lines is smaller compared to the OL recorded image in the case of the first recording condition.

Further, the present embodiment discloses a recording method for performing recording on the recording medium 30 by controlling the recording head 22 including the nozzle row 26 including the plurality of nozzles 23 configured to eject the ink and arranged in the first direction. The recording method includes a recording step for recording, on the recording medium 30, the image formed by the plurality of raster lines that are long in the second direction intersecting the first direction. When performing the OL recording of the raster line forming the partial image of the image, using, of the nozzle row 26, the plurality of OL nozzles in the positional relationship to record the common raster line, the recording step includes performing recording using the OL nozzles of the first range, in the range of the OL nozzles in the first direction, when the recording condition is the first recording condition, and performing recording using the OL nozzles of the second range narrower than the first range, of the range of the overlap nozzles in the first direction, when the recording condition is the second recording condition in which the density difference between the partial image and the image other than the partial image, of the image, is greater than in the first recording condition.

4. MODIFIED EXAMPLES

The switching of the ranges used in the OL recording in the OL nozzle range of the nozzle row 26 is not limited to exclusively switching to one of the first range and the second range. The greater the tendency for the recording condition to increase the density difference between the partial image, namely, the OL recorded image, and the normal recorded image, which is the image other than the partial image, the more the control unit 11 may narrow the range of the nozzles 23 used for the OL recording in the OL nozzle range. In other words, the amount of the OL recorded image may be more finely adjusted in accordance with the recording condition.

The control unit 11 may determine the recording condition from a combination of two or more conditions among a plurality of conditions, such as the recording speed, the temperature, the humidity, the type of the recording medium, and the like. For example, the recording condition may be determined to be the second recording condition when two or more of the plurality of conditions correspond to the second recording condition. Further, for example, when one of the plurality of conditions corresponds to the second recording condition, the recording condition may be determined to be the second recording condition, and when two or more of the conditions correspond to the second recording condition, the recording condition may be determined to be a third recording condition. Then, in the case of the third recording condition, the control unit 11 may determine the range of the nozzles 23 used for the OL recording such that the amount of the OL recorded image is less than the case in which the amount of the OL recorded image is the second recording condition.

The printer 20 used in the present embodiment may be a so-called line printer, as described below, rather than the serial printer.

Figure 6:
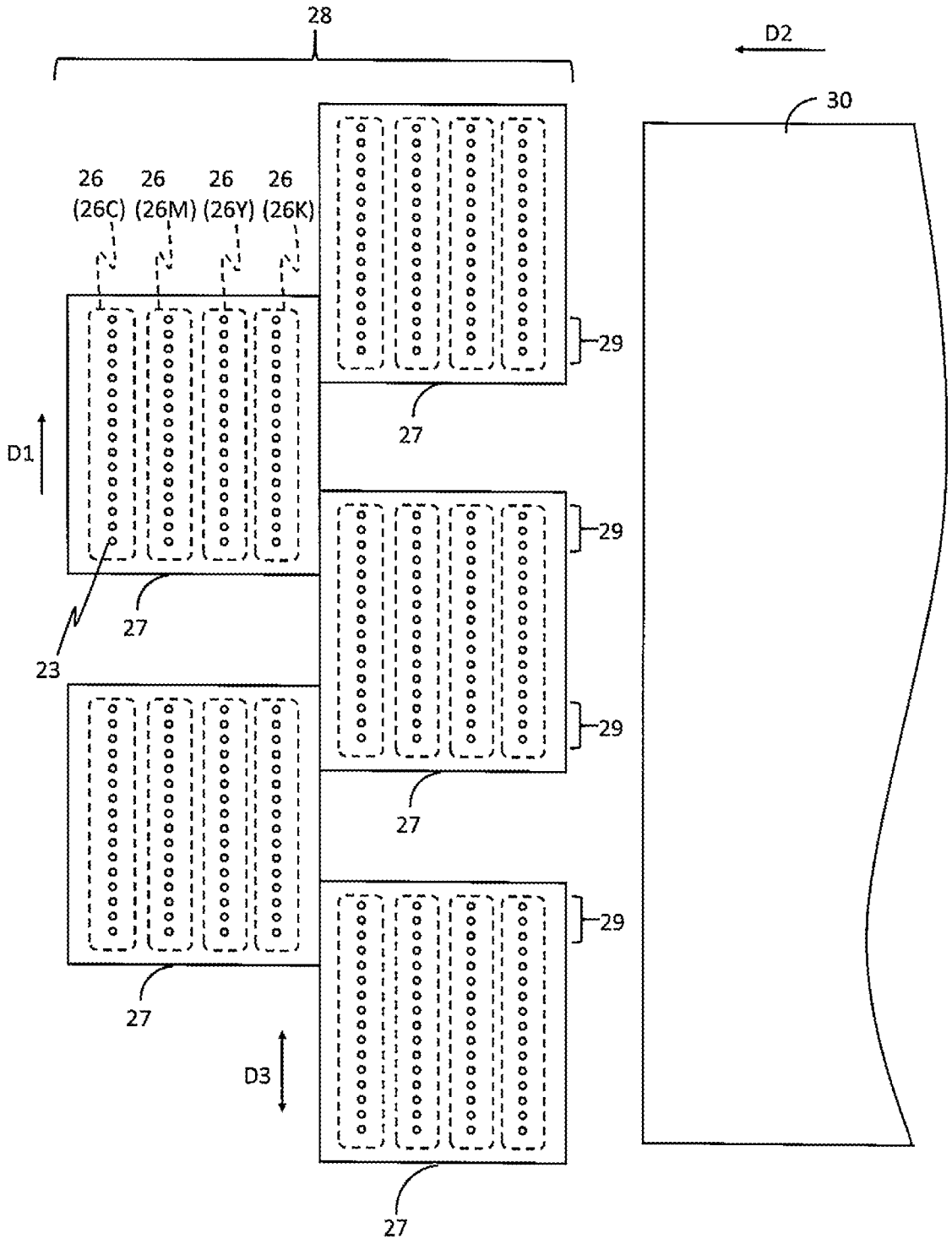
FIG. 6 is a diagram illustrating, from above, another example of a relationship between the recording medium and a recording head.

FIG. 6 schematically illustrates a correspondence relationship between a recording head 28 and the recording medium 30 in the printer 20, which is the line printer. The printer 20, which is the line printer, includes the recording head 28 instead of the recording head 22, and does not include the carriage 24.

The relationship of the directions D1, D2, and D3 is as previously described. However, when the printer 20 is the line printer, the direction D3 is not referred to as the transport direction, and is referred to as the main scanning direction or the width direction of the recording medium 30. The direction D2 is not referred to as the main scanning direction, and is referred to as the transport direction. The transport mechanism 21 transports the recording medium 30 in the transport direction D2. The recording head 28 has a long configuration having a length that can cover the width of the recording medium 30, by connecting a plurality of nozzle chips 27 each having the same configuration along the width direction D3, and is fixed in a predetermined position on the transport path of the recording medium 30. The individual nozzle chips 27 configuring the recording head 28 may be understood to have a configuration similar to that of the recording head 22 illustrated in FIG. 2. The recording head 28 ejects dots from each of the nozzles 23 onto the recording medium 30 transported in the transport direction D2.

In other words, by connecting, in the width direction D3, the plurality of nozzle chips 27 each including the nozzle rows 26C, 26M, 26Y, and 26K for each of CMYK, the recording head 28 as a whole is configured to have a length that can cover the width of the recording medium 30 and to include the respective nozzle rows for each of CMYK. According to the configuration illustrated in FIG. 6, the transport direction D2 corresponds to the "second direction", and the raster line is the line that is long in the transport direction D2. The mutually connected nozzle chips 27 are connected so that portions of the nozzle rows overlap each other in the nozzle row direction D1. In this way, a range over which the portions of the nozzle rows overlap between the nozzle chips 27 is an OL nozzle range 29. Each of the nozzles 23 belonging to the OL nozzle range 29 is the OL nozzle having the positional relationship capable of recording the common raster line. In accordance with the determination of the first recording condition or the second recording condition as described above, the control unit 11 determines the range of the nozzles 23 used for the OL recording in the OL nozzle range 29 to be the first range or the second range that is narrower than the first range, and records a part of the input image as the OL recorded image. Note that, when the printer 20 is the line printer, the recording speed is the transport speed of the recording medium 30 by the transport mechanism 21.

In the present embodiment, the concept of the density difference between the OL recorded image and the normal recorded image increasing more than in the first recording condition also includes a case in which the density difference increases as a result of the density of the OL recorded image becoming lighter than in the first recording condition. For example, even when recording the same image, the density of the OL recorded image may change as a result of a different type of ink being used by the recording head 22. While, on the one hand, when recording a given image on the recording medium 30 using a first type of ink, the density difference between the OL recorded image and the normal recorded image is within a predetermined extent, on the other hand, when recording the image on the recording medium 30 using a second type of ink, the OL recorded image may be lighter than when using the first type of ink, and thus, the density difference with the normal recorded image may increase. Assuming such a case, the use of the first type of ink can be taken as the first recording condition and the use of the second type of ink can be taken as the second recording condition.

What is claimed is:

1. A recording device comprising:

a recording head including a nozzle row including a plurality of nozzles configured to eject ink and arranged in a first direction; and a control unit configured to record an image on a recording medium by controlling the recording head, the image being formed by a plurality of raster lines that are long in a second direction intersecting the first direction, wherein when recording a raster line forming a partial image of the image, using, of the nozzles of the nozzle row, a plurality of overlap nozzles in a positional relationship for recording a common raster line, the control unit performs recording using the overlap nozzles of a first range, in a range of the overlap nozzles in the first direction, when a recording condition is a first recording condition, and performs recording using the overlap nozzles of a second range narrower than the first range, of the range of the overlap nozzles in the first direction, when the recording condition is a second recording condition in which a density difference between the partial image and an image other than the partial image of the image is greater than in the first recording condition.

2. The recording device according to claim 1, wherein a recording speed of the second recording condition is slower than that of the first recording condition.

3. The recording device according to claim 1, wherein a temperature of the second recording condition is lower than that of the first recording condition.

4. The recording device according to claim 1, wherein a humidity of the second recording condition is higher than that of the first recording condition.

5. The recording device according to claim 1, wherein the second recording condition uses a recording medium in which bleed-through of the ink is more likely to occur than the recording medium used in the first recording condition.

6. The recording device according to claim 1, wherein the second range is a central range not including both of end portions of the range of the overlap nozzles in the first direction.

7. A recording method for performing recording on a recording medium by controlling a recording head including a nozzle row including a plurality of nozzles configured to eject ink and arranged in a first direction, the recording method comprising:

a recording step for recording, on the recording medium, an image formed by a plurality of raster lines that are long in a second direction intersecting the first direction, wherein the recording step includes, when recording a raster line forming a partial image of the image, using, of the nozzle row, a plurality of overlap nozzles in a positional relationship for recording a common raster line, performing recording using the overlap nozzles of a first range, in a range of the overlap nozzles in the first direction, when a recording condition is a first recording condition, and performing recording using the overlap nozzles of a second range narrower than the first range, of the range of the overlap nozzles in the first direction, when the recording condition is a second recording condition in which a density difference between the partial image and an image other than the partial image, of the image, is greater than in the first recording condition.

* * * * *